United States Patent [19]

Rakitsch

[11] Patent Number: 4,467,239

[45] Date of Patent: Aug. 21, 1984

[54] STRUCTURAL UNIT COMPRISING A REFLECTOR AND A HALOGEN CYCLE INCANDESCENT LAMP OF LOW WATTAGE

[75] Inventor: Peter Rakitsch, Ismaning, Fed. Rep. of Germany

[73] Assignee: Patent-Treuhand-Gesellschaft fur Elektrische Glühlampen mbH, Munich, Fed. Rep. of Germany

[21] Appl. No.: 319,785

[22] Filed: Nov. 9, 1981

[30] Foreign Application Priority Data

Dec. 18, 1980 [DE] Fed. Rep. of Germany ..... 3047841

[51] Int. Cl.[3] ..... H01J 61/33; F21V 7/00

[52] U.S. Cl. ..... 313/113; 362/347; 362/350

[58] Field of Search ..... 313/113; 362/347, 350; 350/293

[56] References Cited

U.S. PATENT DOCUMENTS 3,381,575 5/1968 Levin ..... 313/113 X

FOREIGN PATENT DOCUMENTS 1183481 3/1970 United Kingdom ..... 362/347

OTHER PUBLICATIONS

*IES Lighting Handbook* Fourth Ed., 1966 pp. 6-10 to 6-61.

*Primary Examiner*—Palmer C. Demeo
*Assistant Examiner*—Sandra L. O'Shea
*Attorney, Agent, or Firm*—Frishauf, Holtz, Goodman & Woodward

[57] ABSTRACT

To reduce the accuracy requirements and permit greater tolerance in placing of a filament of a halogen cycle incandescent lamp (2) of low wattage, for examle 200 W, within a reflector, particularly to provide a source for projection of super-8 mm film on a ground-glass screen surface, the reflector is positioned in a range in accordance with the hyperbolic equations:

A:
$0.1477x^2+1.2617xy+y^2-31.461x+58.1-19y-1577.1=0$ and

B:
$0.1201x^2+1.2503xy+y^2-30.554x+56.0-82y-1449.7=0.$

Preferably, the curvature of the hyperbola equation is

C:
$0.1339x^2+1.2570xy+y^2-31.028x+57.1-40y-1513.4=0.$

2 Claims, 2 Drawing Figures

STRUCTURAL UNIT COMPRISING A REFLECTOR AND A HALOGEN CYCLE INCANDESCENT LAMP OF LOW WATTAGE

The invention relates to a structural unit comprising a reflector and a halogen cycle incandescent lamp of low wattage, e.g. about 200 W, for use in super-8 (S8) motion picture film reproduction devices with ground-glass screen projection.

BACKGROUND

The curvature of the reflective area of the reflector of known structural units of this type corresponds to a curve whose points fulfill the elliptic equation $$0.4604x^2+0.0483xy+y^2+11.7134x+1.0703y-263.5781=0.$$

In order to generate the impression that the ground-glass screen of the S8-reproduction device is uniformly illuminated, care has to be taken in the manufacture of these structural units—even more than with the known units comprising higher wattage halogen cycle incandescent lamps for the above application—that the filament of the lamp is, relative to the reflector associated with it, very precisely in the predetermined position. In other words, the range of tolerance is very small. This is a very serious difficulty, especially in quantity production, since the lamp filament must be positioned at 2/100 millimeter precisely in the burning position within the reflector. The size of the S8 film window is standardized and determined by the S8 film format. The standard distance between the window and reflector surface is 27.6 mm. The center of the light source, for example the filament, must be accurately located at 35.5 mm from the film window plane. The lamp, which has a finite size, must be fitted within the reflector. The cup-shaped or generally ellipsoid structure of the reflector, thus, is interrupted in the region of the apex thereof to permit passage of the lamp structure therethrough.

THE INVENTION

It is an object to provide a reflector lamp combination for S8 film projection which does not require such high precision of filament placement.

Briefly, the curvature of the reflective area of the reflector of the structural unit lies within a range which is limited by the curves (hyperbolae)

A:
$$0.1477x^2+1.2617xy+y^2-31.461x+58.1019y-1577.1=0 \text{ and}$$

B:
$$0.1201x^2+1.2503xy+y^2-30.554x+56.0082y-1449.7=0.$$

Preferably, the curvature of the hyperbola equation is

C:
$$0.1339x^2+1.2570xy+y^2-31.028x+57.1040y-1513.4=0.$$

With the reflector in accordance with the invention, an about three to five times larger tolerance range is admissible with respect to the lamp filament position relative to the burning position within the reflector without any drawback for the application of the structural unit. Quantity production thus is no longer impeded.

DRAWINGS

FIG. 1 shows the reflector 1 and a halogen cycle incandescent lamp 2 of low wattage, for instance of 200 W. The curves A and B, see FIG. 2, define the range within which lies the curvature of the reflector in accordance with the hyperbolae equations:

A:
$$0.1477x^2+1.2617xy+y^2-31.461x+58.1019y-1577.1=0 \text{ and}$$

B:
$$0.1201x^2+1.2503xy+y^2-30.554x+56.0082y-1449.7=0.$$

A curvature in accordance with curve (hyperbola)

C:
$$0.1339x^2+1.2570xy+y^2-31.028x+57.1040y-1513.4=0$$

is preferred.

Figure 1:
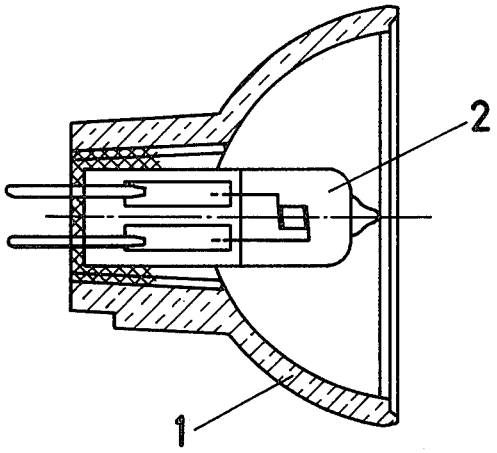
FIG. 1 shows, schematically, the structural unit.
Figure 2:
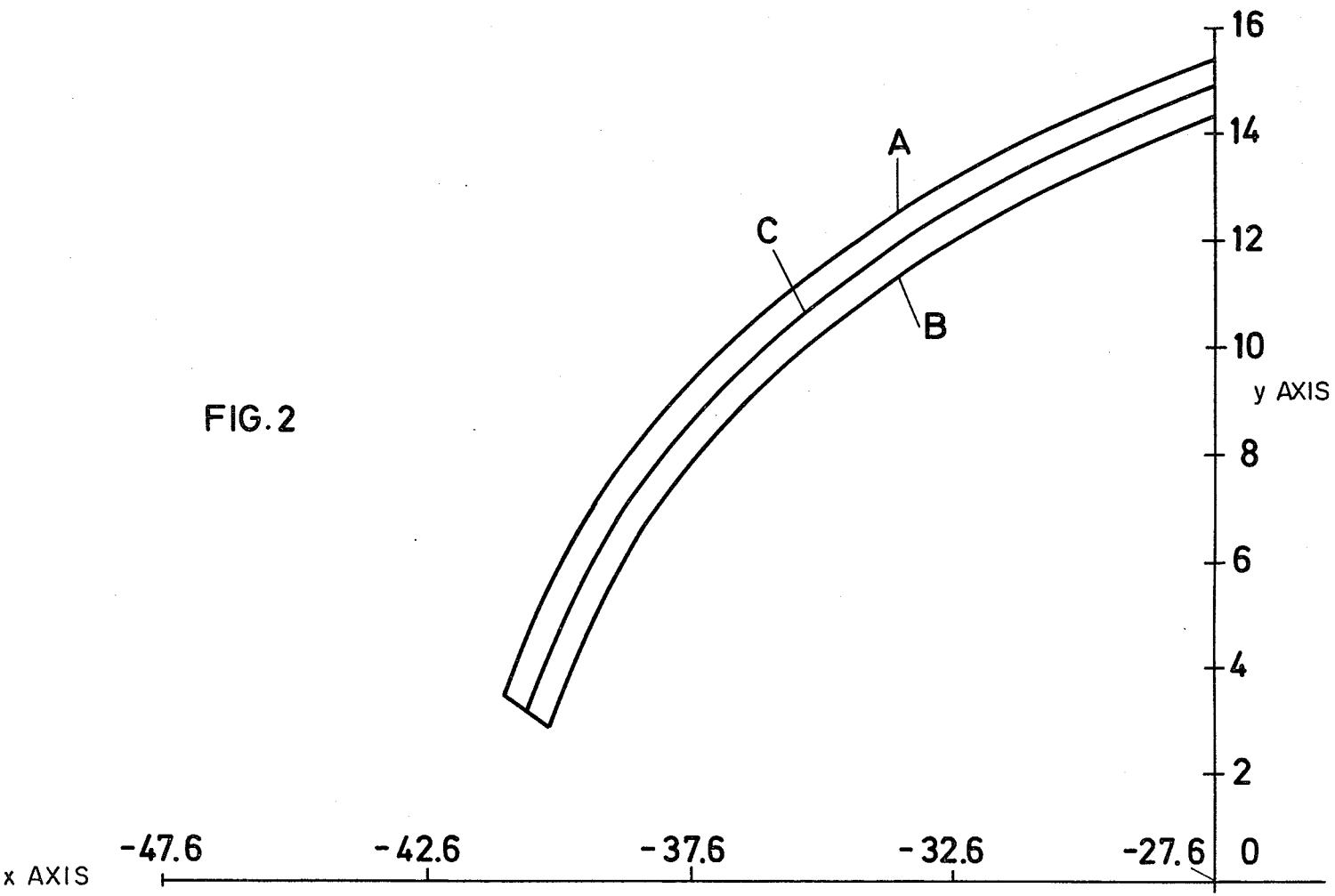
FIG. 2 illustrates the curvature, in which the horizontal axis, or abscissa, is the x axis, and the vertical axis, or ordinate, is the y axis.

FIG. 2 is drawn in the normal manner customary in film projector representation. The film plane is placed in the y axis, the zero point of which is located at exactly the center—with respect to the vertical direction—of the image. In view of customary reading from left to right, and illustration of reflector constructions along the path of the light beam from the origin, that is, from the filament of lamp 2 towards the image plane—in FIG. 1 from left to right—the reflector shape is shown in FIG. 2 in the second quadrant of a standard x-y coordinate system. The coordinate system of FIG. 2 omits the zero-origin point of the x axis since values of x between $-27.6$ and zero are irrelvant due to the distance between image plane and reflector surface, as determined by the standardized format of the film. The curves need not be carried out to the intersection with $y=0$ since the physical size of the lamp 2, located within the reflector, prevents continuation of the reflector to the $y=0$ position. Thus, points with lesser values than $y=$about 41.2 are not needed. In accordance with standardized illumination, the center of the filament of the light source 2 must be placed at $x\approx-35$ mm to obtain the light output which is required to be projected to the standardized film window for the standardized film window for the standardized film format. Points beyond values of $x=41.2$ are not shown in FIG. 2, since not required; they are merely theoretical points which will appear behind the lamp 2 (FIG. 1), and are irrelevant for light transmission from the reflector.

I claim:

1. A structural unit comprising a reflector (1) and a halogen cycle incandenscent lamp (2) of low wattage for use in super-8 reproduction devices with ground-glass screen projection, wherein the curvature of the reflective area of the reflector (1) of the structural unit lies within a range which is limited by the hyperbolic curves A:
$$0.1477x^2+1.2617xy+y^2-31.461x+58.1019y-1577.1=0 \text{ and}$$

B:

$$0.1201x^2+1.2503xy+y^2-30.554x+56.082y-1449.7=0$$

and wherein the value of x is between −27.6 and −41.2.

2. A structural unit as claimed in claim 1, wherein the curvature of the reflective area of the curve corresponds to

C:

$$0.1339x^2+1.2570xy+y^2-31.028x+57.140y-1513.4=0.$$

* * * * *